US006486606B1

(12) United States Patent
Ting

(10) Patent No.: US 6,486,606 B1
(45) Date of Patent: Nov. 26, 2002

(54) DRIVING CIRCUIT OF THIN-FILM TRANSISTOR ELECTROLUMINESCENT DISPLAY AND THE OPERATION METHOD THEREOF

(75) Inventor: Chin-Lung Ting, Tainan (TW)

(73) Assignee: Chi Mei Optoelectronics Corp. (TW)

( * ) Notice: Subject to any disclaimer, the term of this patent is extended or adjusted under 35 U.S.C. 154(b) by 66 days.

(21) Appl. No.: 09/668,311

(22) Filed: Sep. 25, 2000

(30) Foreign Application Priority Data

Jun. 21, 2000 (TW) ..... 89112232 A

(51) Int. Cl.[7] ..... G09G 3/10

(52) U.S. Cl. ..... 315/169.1; 315/169.3; 313/505; 345/76

(58) Field of Search ..... 315/169.1, 169.2, 315/169.3; 313/505, 506, 509, 512; 345/55, 56, 76, 77

(56) References Cited

U.S. PATENT DOCUMENTS 5,793,163 A * 8/1998 Okuda ..... 315/169.3
5,952,789 A * 9/1999 Stewart et al. ..... 315/169.1
6,057,647 A * 5/2000 Kurosawa et al. ..... 315/169.1
6,194,837 B1 * 2/2001 Ozawa ..... 315/169.1
6,307,322 B1 * 10/2001 Dawson et al. ..... 315/169.1

* cited by examiner

*Primary Examiner*—Don Wong
*Assistant Examiner*—Jimmy T. Vu

(57) ABSTRACT

A circuit for driving an organic light-emitting diode (OLED) in a thinfilm transistor electroluminescent (TFT-EL) display at least includes the first and the second transistors. Wherein, a data line and a capacitor are respectively connected to the source and drain electrodes of the first transistor. The capacitor is charged from the data line by turning on the first transistor. And, the capacitor and an OLED are respectively connected to the source and drain electrodes of the second transistor. The capacitor is discharged by turning on the second transistor, and results in light emitting of the OLED.

10 Claims, 2 Drawing Sheets

DRIVING CIRCUIT OF THIN-FILM TRANSISTOR ELECTROLUMINESCENT DISPLAY AND THE OPERATION METHOD THEREOF

FIELD OF THE INVENTION

The present invention relates to a driving circuit of thin-film transistor electroluminescent (TFT-EL) display and the operation method thereof, and more particularly to a driving circuit for driving a light-emitting diode (LED) in TFT-EL display and its operation method.

INTRODUCTION

Rapid advances in flat-panel display (FPD) technologies have made high quality large-area, full-color, high-resolution displays possible. These displays have enabled novel applications in electronic products such as lap top computers and pocket-TVs. Liquid crystal display (LCD) is the fastest one of developing these FPD technologies.

These LCD panels use thin-film-transistors (TFT) as an active-addressing scheme, which relaxes the limitations in direct addressing. The success of LCD technology is in large part due to the rapid progress in the fabrication of large-area TFT substrate. The almost ideal match between TFT switching characteristics and other LCD display elements also plays a key role.

A major drawback of TFT-LCD panels is that they require bright backlighting. This is because the transmittance of the TFT-LCD is poor, particularly for colored panels. Power consumption for backlighted TFT-LCD panels is considerable, and this adversely affects portable display applications.

Moreover, backlighting also increases the entire thickness of the flat panel, for example, using a typical fluorescent tube lamp, the additional thickness is about ¾ to 1 inch. Backlight also adds extra weight to the FPD.

An ideal solution to the foregoing limitation would be a low power emissive display that eliminates the need for backlighting. A particularly attractive candidate is the thin-film-transistor-electroluminescent (TFT-EL) display. In the TFT-EL display, the individual pixels can be addressed to emit light and auxiliary backlighting is not required.

Referring to FIG. 1, a circuit for driving an organic light-emitting diode (OLED) in a TFT-EL display is shown. In the circuit, the OLED is controlled with two thin-film transistors and one capacitor. When the scan line is driven, the transistor T1 is switched on and the signal from the data line is input into a capacitor C. After the capacitor C is charged, a current source $V_{supply}$ supplies a current to drive an organic light-emitting diode (OLED) D according to the I–V characteristic of transistor T2 and the voltage level of the capacitor C. However, even with the same data signal, due to the variance of the I–V characteristic between the individual transistors in the actual manufacturing process, it is hard to control the luminescence uniformity of individual pixels.

SUMMARY OF THE INVENTION

The present invention provides a circuit for driving a light-emitting diode (LED) in a thin-film transistor electroluminescent (TFT-EL) display and the operation method thereof. The circuit including two transistors is used to control the luminescent intensity of the LED. A scan line and a discharge line are used to respectively control the transistors, and such transistors determine charge/discharge of both the capacitor and the LED. Additionally, the LED emits by means of a current through the channel of the transistor when the capacitor is discharged.

The present invention provides a circuit for driving a light-emitting diode (LED) in a thin-film transistor electroluminescent (TFT-EL) display which comprises a data line, a scan line, a discharge line, a capacitor, a lightemitting diode, a first transistor and a second transistor. The first transistor is composed of a first gate electrode, a first source electrode, and a first drain electrode, wherein the first gate electrode is connected to the scan line, the first source electrode is connected to the data line, and the first drain electrode is connected to the capacitor. The second transistor consists of a second gate electrode, a second source electrode, and a second drain electrode, wherein the second gate electrode is connected to the discharge line, the second source electrode is connected to the capacitor and the second drain is connected to the light-emitting diode.

The present invention also provides a method for driving an LED in a TFT-EL display. The method comprises the following steps. A scan signal switches on a first transistor. A charging step is performed thereafter to charge a capacitor from a data line through said first transistor. A discharge signal switches on a second transistor. And, a discharging step is performed thereafter to drive said LED by discharging said capacitor through said second transistor.

BRIEF DESCRIPTIONS OF THE DRAWINGS

DETAILED DESCRIPTIONS OF THE INVENTION

The present invention discloses a circuit for driving light-emitting diodes (LED) in a thin-film transistor electroluminescent (TFT-EL) display and a method of operating the circuit. The driving circuit includes a first transistor, a second transistor, a capacitor, a data line, a scan line and a discharging line. Firstly, the first transistor is switched on by the scan line and the capacitor is charged by the data signal on the data line. After charging the capacitor, the first transistor is switched off, and then the second transistor is switched on with the discharge line and the capacitor is discharged. Therefore, the discharging current from the capacitor drives the OLED luminescent.

Figure 1:
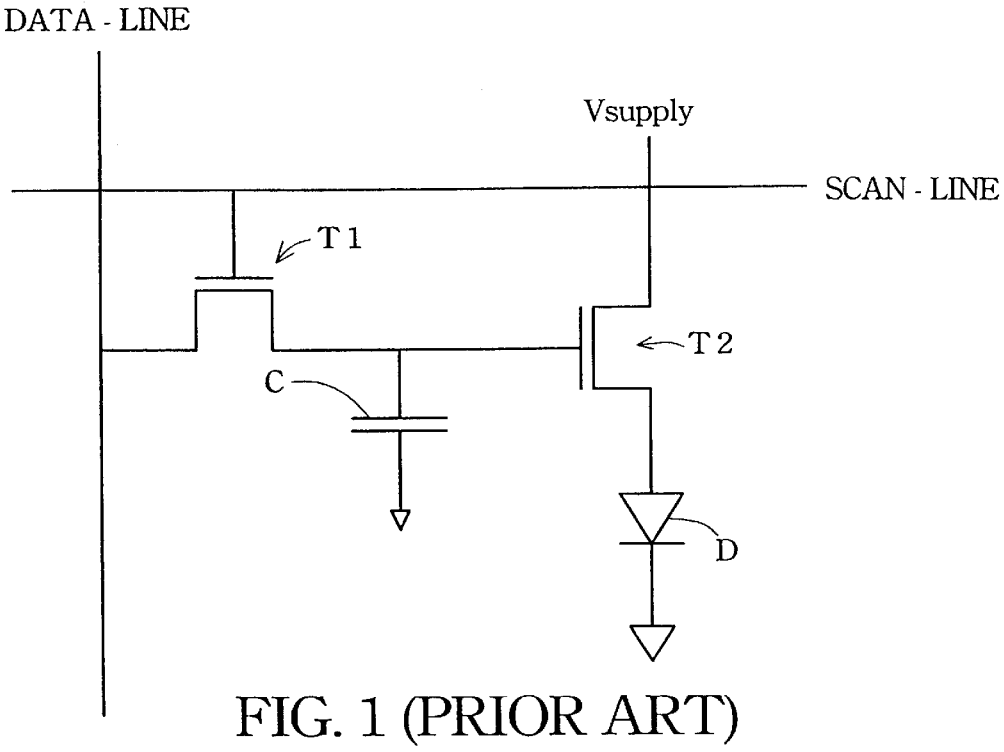
FIG. 1 (PRIOR ART)
FIG. 1 shows a schematic view of a driving circuit for an organic light emitting diode (OLED) in a thin-film transistor electroluminescent (TFT-EL) display in accordance with the prior art.
Figure 2:
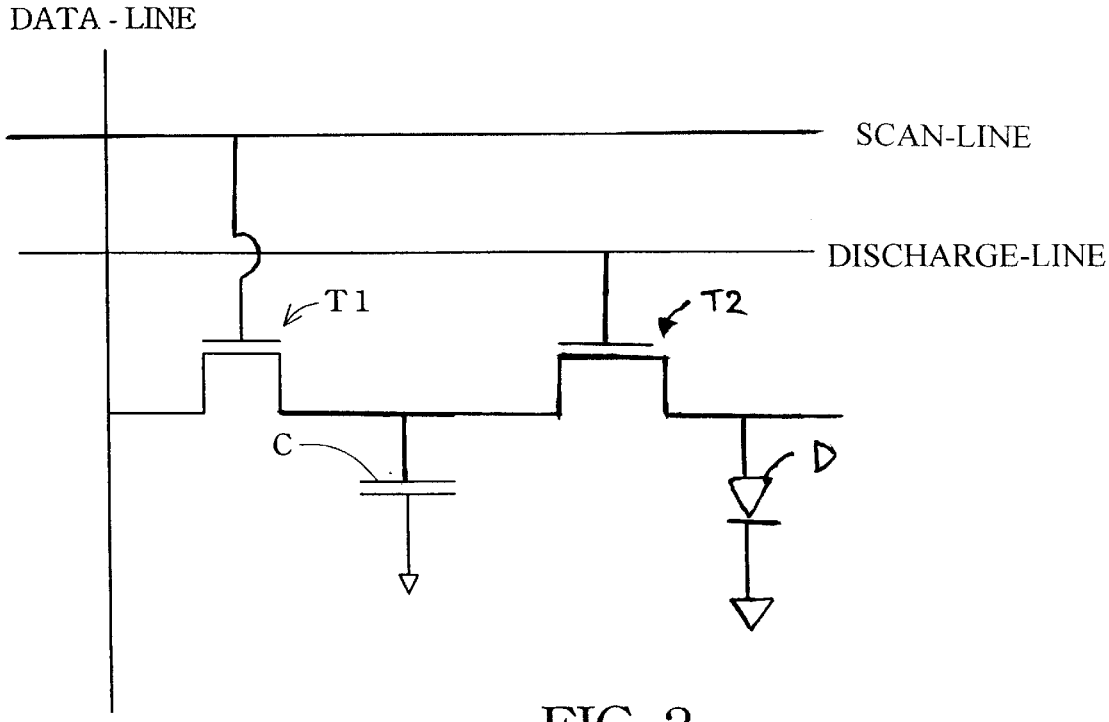
FIG. 2 shows a schematic view of a driving circuit for a light emitting diode (LED) in a thin-film transistor electroluminescent (TFT-EL) display in accordance with the present invention.

Referring to FIG. 2, it shows a schematic view of the circuit for driving organic light-emitting diodes (OLED) in a TFT-EL display. The data signal on a data line controls the luminescence of the organic light-emitting diodes D.

Still referring to FIG. 2, a source electrode of a transistor T1 is connected to the data line and a capacitor C is connected to a drain electrode of the transistor T1. The data line provides a voltage to charge the capacitor C through the transistor T1. The transistor T1 is switched on/off with a scan line by applying a voltage on the gate electrode. While the transistor T1 is on, the data signal charges the capacitor C. Then, the transistor T1 is switched off with the capacitor charged as substantially the same level as the data signal on the data line. According to the formula $Q=Cx\ V_1$, the charge on the capacitor is proportional to the data signal. For a specific time interval later, the transistor T2 is switched on by applying a discharging signal on the discharging line. Since the capacitor is connected to the OLED via the transistor T2, a discharging current from the capacitor drives the OLED luminescent. The luminosity of the OLED is proportional to the current density flowing through and, accordingly, the average luminosity of the OLED in a frame is proportional to the charge stored within the capacitor. As mentioned above, the charge stored within the capacitor is proportional to the data signal. In other words, with the uniformity of capacitor in manufacturing, it is easier to control the uniformity of luminescence for the individual pixel.

The method for operating the driving circuit in a TFT-EL display is explained in the following descriptions. Referring to FIG. 2, the data signal on the data line charges the capacitor C through the channel of the transistor T1 while the transistor T1 is switched on by a scan signal on the scan line. After the charging step is complete, the transistor T1 is switched off by the scan line, and for a specific time interval later, the transistor T2 is switched on by a discharge signal of the discharge line. As the transistor T2 is switched on, the OLED D is driven by the capacitor C through the channel of the transistor T2.

Figure 3:
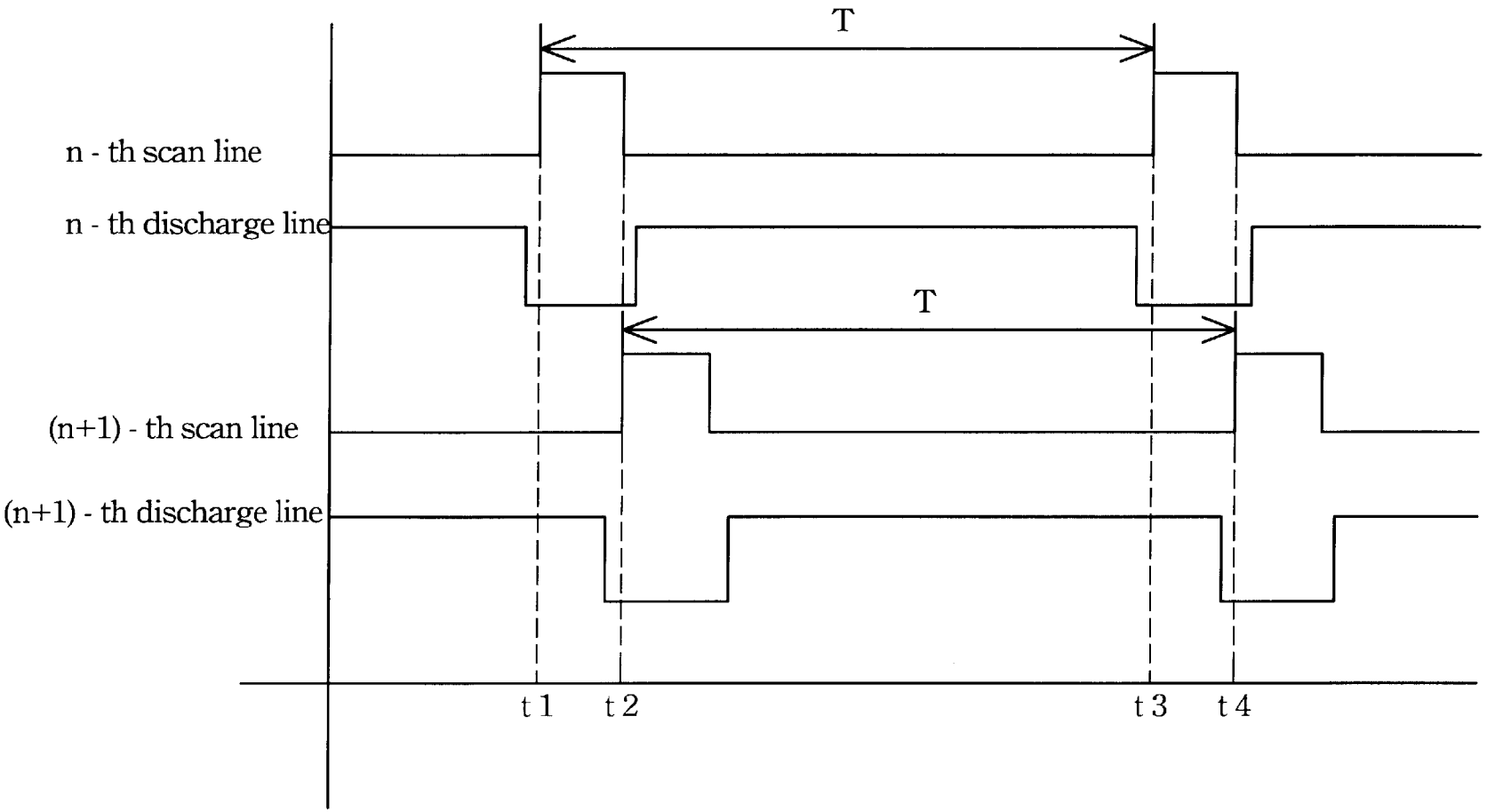
FIG. 3 shows a switching time of the scan line and the discharge line in a TFT-EL display in accordance with the present invention.

Referring to FIG. 3, the time sequence of operating the scan lines and the discharge lines of the driving circuit for the n-th row of OLED and the (n+1)-th row of OLED in a TFT-EL display is represented. The n-th scan line is pulled up to high voltage level at time t1, and pulled down to low voltage level at time t2. Between the time t1 and t2, the transistor T1 of the n-th row of driving circuit is switched on by the n-th scan line and the capacitor C of the n-th row of driving circuit is charged by the data signal on the data lines of the n-th row of driving circuit through the channel of the transistor T1. The discharging signal on the n-th row of discharge lines goes low just a moment before time t1 and goes high just a moment after time t2 to close the transistor T2 between time t1 and t2, while the charging step is in progress. When the n-th row of discharge line maintains a high voltage level between time t2 and t3, the transistor T2 is switched on and the n-th row of OLED in a TFT-EL display is driven by the corresponding capacitor of the n-th row of driving circuit and therefore the n-th row of OLEDs luminesces according to the data signal kept on the corresponding capacitor.

After the charging/discharging step of the capacitor C of the n-th row of driving circuits for the n-th row of OLED of the TFT-EL display is finished, the (n+1)-th scan line of the TFT-EL display is pulled up and the charging/discharging steps in the (n+1)-th row of driving circuits is performed sequentially. The operation of the (n+1)-th row of driving circuits of the TFTEL display is similar to that of the n-th row of driving circuits.

In the present invention, the transistor T2 is controlled by the discharge signal on the discharge line and is indicated as a switching element between the capacitor and the OLED. That means the charges flowing into the OLED through the channel of the transistor T2 do not vary with the I–V characteristic of the transistor T2. Moreover, the luminescent intensity of the OLED in a frame depends on the amount of the charges provided by the capacitor. The more charges the capacitor provides, the more electron-hole pairs recombination occurs in OLED to generate light. The luminescent intensity of the OLED relates to the amount of the electron-hole pairs. Therefore, the luminescent intensity of the OLED is not decided by the I–V characteristic of the transistor T2. When the luminescent intensity of the OLED is not influenced by the I–V characteristic, it becomes more uniform, thereby enhance the quality of the flat display.

While the preferred embodiment of the invention has been illustrated and described, it will be appreciated that various changes can be made therein without departing from the spirit and scope of the invention.

What is claimed is:

1. A circuit for driving a light-emitting diode (LED) in a thin-film transistor electroluminescent (TFT-EL) display, comprising:

a data line;

a scan line;

a discharge line;

a capacitor;

a light-emitting diode;

a first transistor having a first gate electrode, a first source electrode, and a first drain electrode, wherein the first gate electrode is connected to the scan line, the first source electrode is connected to the data line, and the first drain electrode is connected to the capacitor; and a second transistor having a second gate electrode, a second source electrode, and a second drain electrode, wherein the second gate electrode is connected to the discharge line, the second source electrode is connected to the capacitor and the second drain electrode is connected to the light-emitting diode.

2. The circuit according to claim 1, wherein said first transistor is switched on and the second transistor is turned off, when said data line charges said capacitor through said first transistor.

3. The circuit according to claim 1, wherein said LED is driven by said capacitor through said second transistor.

4. A method for driving a light-emitting diode (LED) in a thin-film transistor electroluminescent (TFT-EL) display, comprising:

inputting a scan signal for switching on a first transistor;

charging a capacitor by a data signal from a data line through said first transistor;

switching off said first transistor by discontinuing said scan signal, after said charging step is completed;

inputting a discharge signal for switching on a second transistor; and driving said LED by discharging said capacitor through said second transistor.

5. The method according to claim 4, wherein said scan signal is input from a scan line of said TFT-EL display and is applied on a gate of said first transistor.

6. The method according to claim 4, wherein said discharge signal is input from a discharge line of said TFT-EL display and is applied on a gate of said second transistor.

7. The method according to claim 4, wherein said second transistor is switched on and said first transistor is switched off when said LED is driven by the capacitor.

8. The method according to claim 4, wherein said second transistor is switched off and said first transistor is switched on during said charging step.

9. A circuit for driving a light-emitting diode (LED) in a thin-film transistor electroluminescent (TFT-EL) display, comprising:

a data line;

a scan line;

a discharge line;

a capacitor;

a light-emitting diode;

a first transistor having a first gate electrode, a first source electrode, and a first drain electrode, wherein the first gate electrode is connected to the scan line, and the first source electrode is connected to the data line, and the first drain electrode is connected to the capacitor; and a second transistor having a second gate electrode, a second source electrode, and a second drain electrode, wherein the second gate electrode is connected to the discharge line, and the second source electrode is connected to the capacitor, and the second drain electrode is connected to the light-emitting diode, said light-emitting diode being driven by a discharging current from said capacitor through said second transistor.

10. The circuit according to claim 9, wherein said first transistor is switched on and the second transistor is turned off, when said data line charges said capacitor through said first transistor.

* * * * *